US007322945B2

(12) United States Patent
Dunmore

(10) Patent No.: US 7,322,945 B2
(45) Date of Patent: Jan. 29, 2008

(54) HEATED LATHER SHAVING CREAM AND OIL APPLICATOR

(75) Inventor: Joseph C. Dunmore, University Park, IL (US)

(73) Assignee: Joseph C. Dunmore, Sr., Monee, IL (US)

( * ) Notice: Subject to any disclaimer, the term of this patent is extended or adjusted under 35 U.S.C. 154(b) by 277 days.

(21) Appl. No.: 10/884,648

(22) Filed: Jul. 2, 2004

(65) Prior Publication Data

US 2005/0107724 A1 May 19, 2005

Related U.S. Application Data

(60) Provisional application No. 60/523,033, filed on Nov. 18, 2003.

(51) Int. Cl.
*A61H 1/00* (2006.01)

(52) U.S. Cl. ..... 601/15; 601/17

(58) Field of Classification Search ..... 601/15, 601/17, 70, 72, 73, 80; 401/155, 158, 160–161, 401/183, 205
See application file for complete search history.

(56) References Cited

U.S. PATENT DOCUMENTS

| | | | | |
|---|---|---|---|---|
| 2,385,501 | A * | 9/1945 | Fevas | 601/17 |
| 3,754,548 | A * | 8/1973 | McGrath | 601/154 |
| 4,040,414 | A * | 8/1977 | Suroff | 601/2 |
| 6,511,445 | B2 * | 1/2003 | Sivan et al. | 601/6 |
| 6,911,010 | B2 * | 6/2005 | Dirks et al. | 601/15 |
| 2003/0171647 | A1 * | 9/2003 | Garland | 600/38 |
| 2005/0066996 | A1 * | 3/2005 | France et al. | 134/6 |
| 2005/0250076 | A1 * | 11/2005 | Rhoades | 433/217.1 |

* cited by examiner

*Primary Examiner*—Michael A. Brown

(57) ABSTRACT

An applicator for providing product to the body is provided. In a preferred embodiment product is placed on the comb-like teeth of the device, either though a pumping action or by direct placement, and then applied to the skin. Several of the disclosed applicators of the present invention are provided with one or more of heating, vibrating and articulating means such that the user can have a desirable experience in using the product. The applicators further permit those who could otherwise not reach various parts of their body for such needs as shaving, lotion application, or massage, to reach their entire body. Beneficial effects of warm products and massage are made available to the user.

20 Claims, 6 Drawing Sheets

HEATED LATHER SHAVING CREAM AND OIL APPLICATOR

FIELD OF THE INVENTION

The present invention concerns a cream, lather and/or oil dispensing applicator that allows for the distribution of product onto skin. More particularly the present invention concerns the use of a dispensing applicator to apply products, either warmed or at ambient temperatures, and/or using vibrations. Further, the product allows a user with arthritis or other debilitating conditions or infirmaries to apply product to themselves without assistance.

BACKGROUND OF THE INVENTION

Cleansing, conditioning, shaving and relaxation products are widely sold and used by persons on themselves, and by service personnel such as barbers, masseurs, healthcare workers and others, on clients. Most such products are sold in containers and are used directly therefrom, in their ambient condition, that is generally at room temperature. Typically, however, products that are under pressure, such as shaving creams and some lotions, emerge from containment somewhat chilled. In most instances, however, it would be preferable to have the product in a warmed state such that it is at or about skin temperature. In a warmed state products are less likely to cause discomfort and or shock. Further, chilled products tend to cause skin pores to close such that medication or soothing products cannot not be well dispersed. Further, with respect to shaving products, cold products can cause skin retractions which do not permit for a close comfortable shave.

It has also been found that persons having arthritis or other such conditions, infirmaries or other debilitating conditions, which do not allow for a full range of movements of one or both arms and/or movements in the hands and fingers, are not able to apply creams, lotions and conditioners to various parts of their bodies. Such persons, further, also typically have trouble working the product into the skin such that the product has its greatest effect possible. It would be desirable to have a device which could allow a user to reach every part of his or her body and carefully and deliberately apply and work in the products as needed.

Further, such persons as barbers, personal trainers, masseuses, physicians and other health care providers, are often requested to use warmed products on their charges such that the product must be warmed up, handled and placed on the body part. In such instances, in order to provide the appropriate and desirable heat to the body and taking into account the tendency of the product to lose heat as it is moved to the body, the product must typically be warmed to a higher, possibly uncomfortable, temperature such that when placed on the body its temperature is ideal for the intended use. Also, it may be preferable to the person applying product and to the person receiving product that minimal physical contact be made. It would be desirable to have a device which could allow a profession to apply warmed product to a body without being scalded by the product and to be able to work the product into their client's skin easily and effectively.

SUMMARY OF THE INVENTION

In accordance with the present invention, an extended applicator having a port for the entry of products such as lotions, creams and oils, is provided. The applicator, in a preferred embodiment, is provided with means to warm the product up to desired temperatures for comfortable application to skin. In a further embodiment, the applicator is provided with means allowing vibration such that the product can be massaged into the skin. In another embodiment, the applicator has an articulated segment which allows it to be folded or bent such that it can be placed flat against the skin in a number of different positions.

In a preferred embodiment ports which are within the surface of the applicator are connected to supplies of creams, oils or foams such that when desired, the product is pushed out onto the surface of the applicator, such that it can subsequently be applied to the body. In one embodiment, the surface of the applicator is provided with small ridges, or shelves, such that the product (creams, oils or foams or others) can be placed prior to placement on the body or face of a user.

The applicator of the present invention can draw various types of product from a number of sources such that it can be used for a variety of needs, including but not limited to: shaving (both face, legs and others), massage (though the use of warm oils and vibration feature), topical medicines and others.

In some embodiments, once applied, the applicator can be used to remove excess product and move it to other parts of the body such that waste of product is diminished: the applicator can be used such that the product is held thereon until the product is applied to the body. In this manner mess is avoided: the vibrating element of the device of the present invention permits the product to be worked into the skin with little or no effort on the part of the user. The device also gives a beneficial and/or pleasurable massage. In this manner persons with disabilities can use products which the previously could not apply and or work into their skin.

In one embodiment, the applicator is powered by electricity from a wall or outlet connection. In a preferred embodiment, the applicator is battery powered, using batteries that are rechargeable, and in some embodiments can be recharged within the unit, in any manner known in the art. In another embodiment, a second device is provided to allow the placement of the product onto the face of the applicator, such that no means to pump product through the applicator is needed.

A more detailed explanation of the invention is provided in the following description and claims and is illustrated in the accompanying drawings.

DETAILED DESCRIPTION OF THE ILLUSTRATIVE EMBODIMENT

Figure 1:
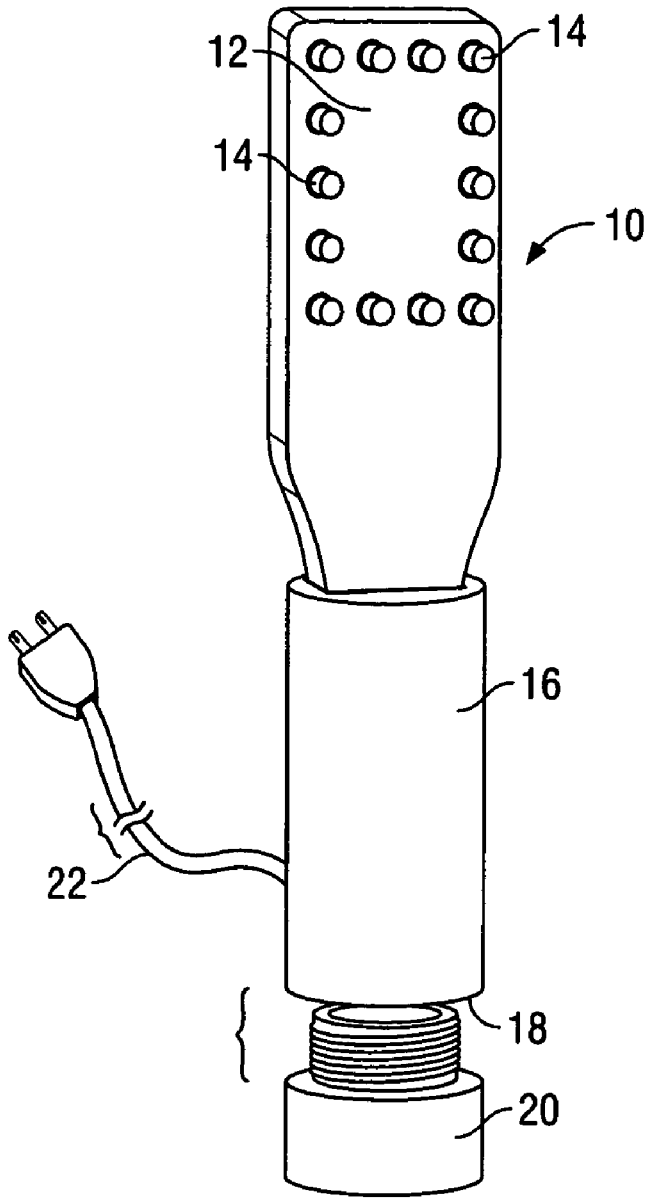
FIG. 1 is a perspective view of an applicator made in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring to the drawings, FIG. 1 shows a product applicator 10 comprising a first application pad 12, having tubular product dispensing ports 14, a handle 16 and a port 18 though which product in containers 20 may be attached to applicator 10. In the present embodiment, applicator 10 is powered by alternating current provided through a cord and plug 22. It will be understood by persons having skill in the art that while one type of cord and plug 22 is shown, any manner of transmitting electricity, in any desirable voltage and amperage, including the use of transformers, charging devices, batteries, or both batteries, either rechargeable or otherwise and a transformer/charger, or other means known in the art, is contemplated for use in the device, and within the novel scope of the present invention.

In a preferred embodiment the applicator is comprised of plastic materials. It will be understood by persons having skill in the art that any number and types of materials, well known in the art, can be used to construct the device of the present invention without departing from the novel scope therein.

Figure 2:
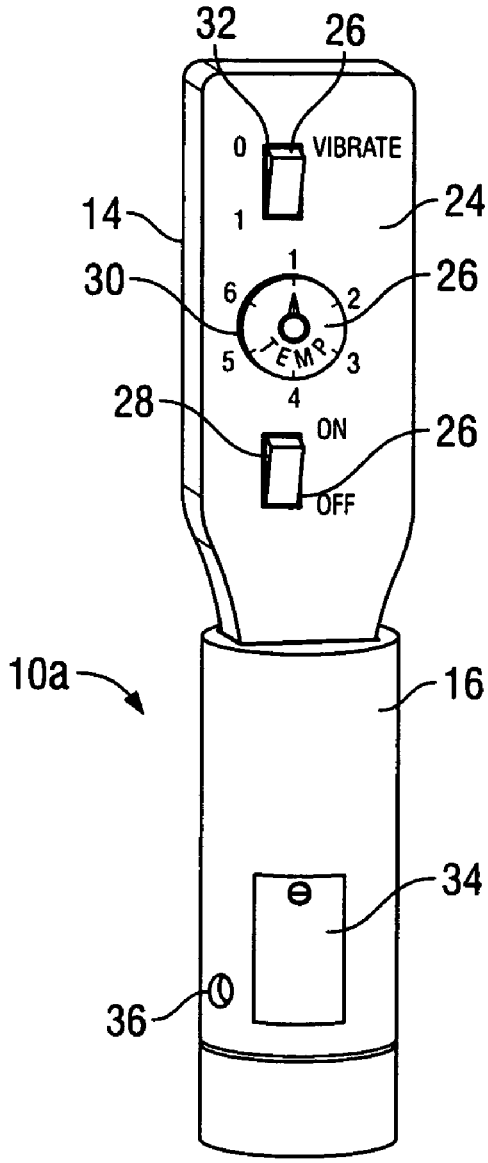
FIG. 2 is a perspective view of another embodiment of an applicator made in accordance with the teachings of the present invention.

Referring to FIG. 2, a second embodiment of applicator 10*a* is shown. It will be understood that the difference in the devices of FIGS. 1 and 2 is that FIG. 1 shows a device powered by alternating current and FIG. 2 shows a battery operated device. It will be understood by persons having ordinary skill in the art that the devices shown in FIG. 1 and FIG. 2 can each be equipped substantially identically without departing from the novel scope of the present invention. FIG. 2 shows the back side of applicator 10*a* comprising similar elements, numbered identically, as in FIG. 1. Further, applicator 10*a* has an operating panel 24 on which controls 26 are placed. Among the controls which can be placed on the device of the present invention are an on/off switch 28, a temperature control 30, such as a thermostat, and a vibration control switch 32. It will be understood by persons having skill in the art that various modifications can be made to the controls of applicator 10*a* without departing from the novel scope of the present invention. For example, one such device could include a heat element without a vibrating element, or a heat element having a simple on/off switch and no thermostatic control. Applicator 10*a* further comprises a batter compartment 34 and a power entry point 36 through which external power can be applied, either to operate applicator 10*a* or to charge batteries within compartment 34 in a manner well known in the art.

Figure 3:
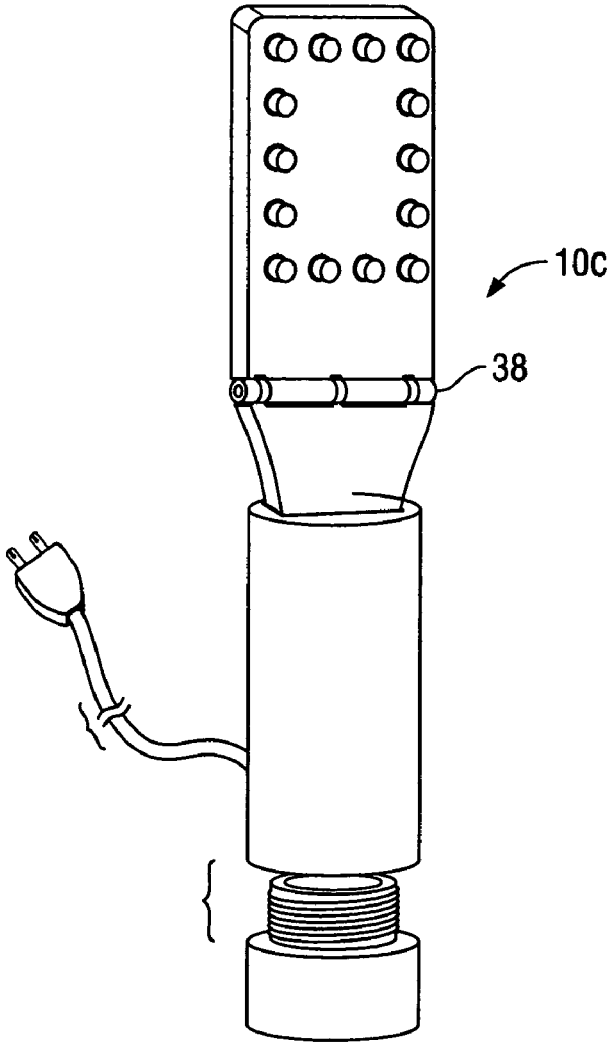
FIG. 3 is a perspective view of another embodiment of an applicator made in accordance with the teachings of the present invention.
Figure 4:
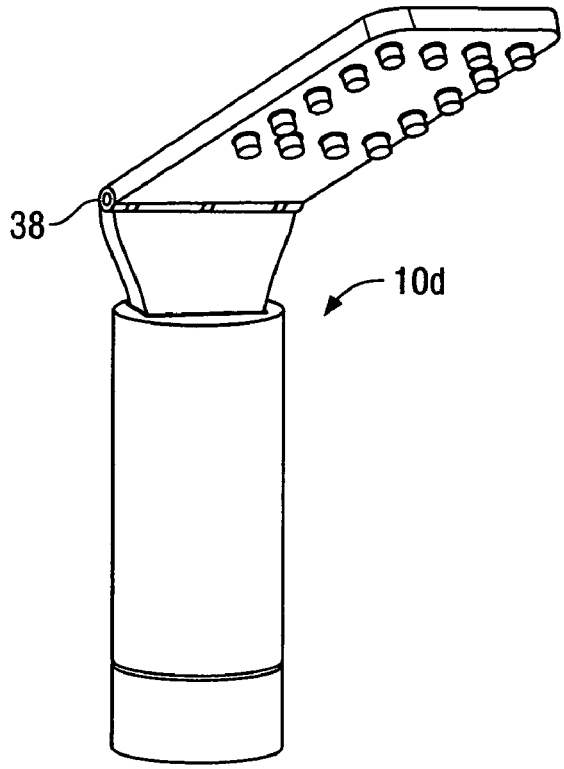
FIG. 4 is a perspective view of another embodiment of an applicator made in accordance with the teachings of the present invention.
Figure 6:
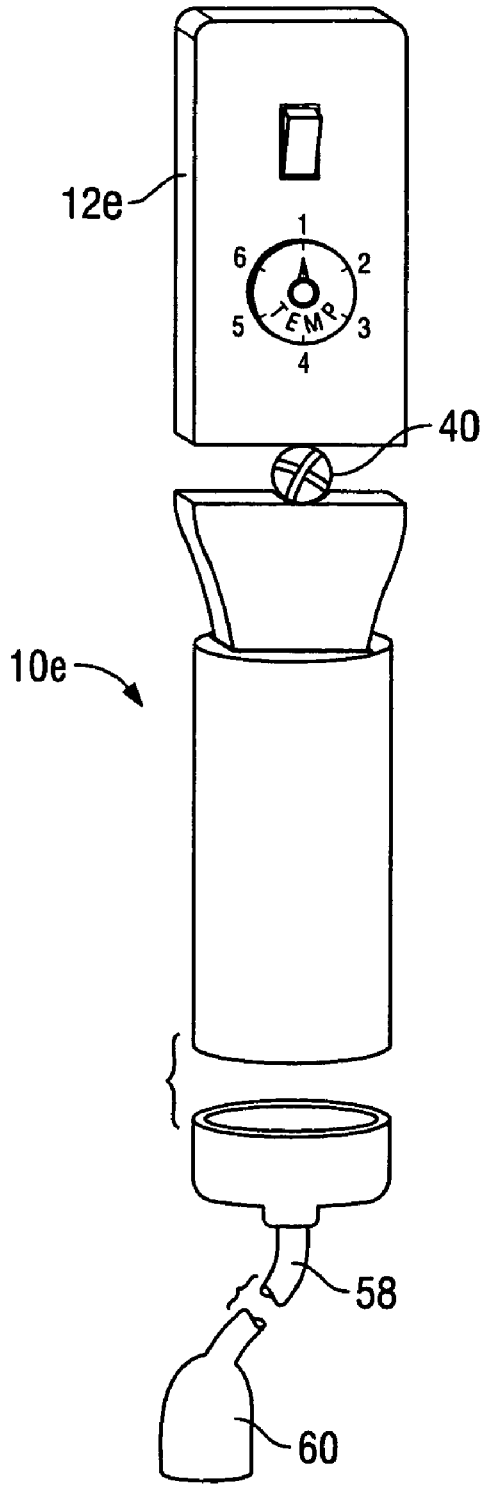
FIG. 6 is a perspective view of another embodiment of an applicator made in accordance with the teachings of the present invention.

Referring now to FIGS. 3 and 4 it can be seen that applicators 10*c* and 10*d*, respectively, are shown. Applicators 10*c* and 10*d* are similar to applicators 10 *a* and 10*b* except that they are provided with a hinge member 38, which permit the applicators to be articulated to a desired shape and orientation. As a result of the ability to articulate, products are delivered where desired with the least effort and the most comfort. FIG. 3 shows applicator 10*c* in an unarticulated, or erect, position. FIG. 4 shows applicator 10*d* in one of an infinite number of articulated positions. It will be understood that applicators 10*c* and 10*d* can be adjusted to any number of positions within the range of hinge member 38 offering a comfortable application to all users. Referring to FIG. 6, an applicator 10*e* allowing both articulations such as shown in FIG. 4 and also twisting motions, along the longitudinal axis of applicator 10*e*, is shown. Applicator 10*e* comprises, along with other elements as shown in previous figures, an articulating ball 40 which permits both articulation and twisting of the application pad 12*e* of applicator 10*e* to any desired position.

Figure 5:
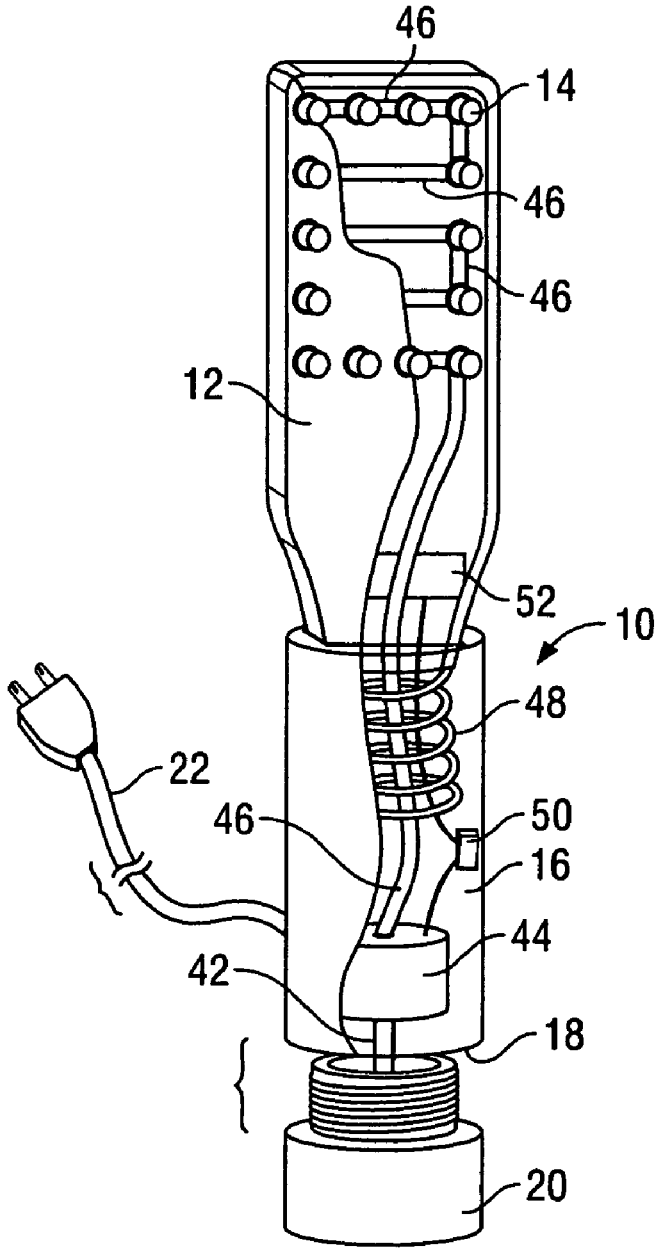
FIG. 5 is a perspective view, partially cut-away to show the interior mechanism, of the applicator of FIG. 1.

Referring to FIG. 5 a cut-away view of applicator 10 of FIG. 1 is shown. The interior mechanisms of applicator 10 comprise, a suction tube 42 for insertion into container 20. Suction tube 42 permits applicator 10 to draw in products for use as described herein. A pump 44 is provided to draw product through suction tube 42 and into the device. Pump 44 may be of any type of pump effective to draw product from containers and push product through the device of the present invention. In a preferred embodiment, pump 44 is self-priming thereby permitting ease in use and ease in change-out from one product to the next, as needed.

A tube path 46 for taking product from pump 44, through heating coils 48 and up through and between dispensing ports 14 is included. A microprocessor 50 is provided to cause pump 44, heating coils 48 and other elements of applicator 10 to function and work together. It will be understood that while the above elements are shown and described in a certain manner other manner and means of causing applicator 10 to function in this manner are contemplated and are within the novel scope of the present invention.

It will be understood that means 52, of a type well known in the art, which permits vibrations in applicator 10, are provided and can be caused to work by microprocessor 50.

Referring again to FIG. 6, it will be seen that product jar 20 has been replaced, in the present embodiment, with a connector 56, tube 58 and large supply of product 60. In an application where, for example, a product, such as warm oil, will be applied to the entire body of an individual, the user will find it more convenient to have bulk quantities of the product available. In this manner the user can continuously apply product without changing bottles or jars. It will be understood that pump 44 will be of sufficient capacity to draw product from great distances allowing for the use of distally place product containers.

Figure 7:
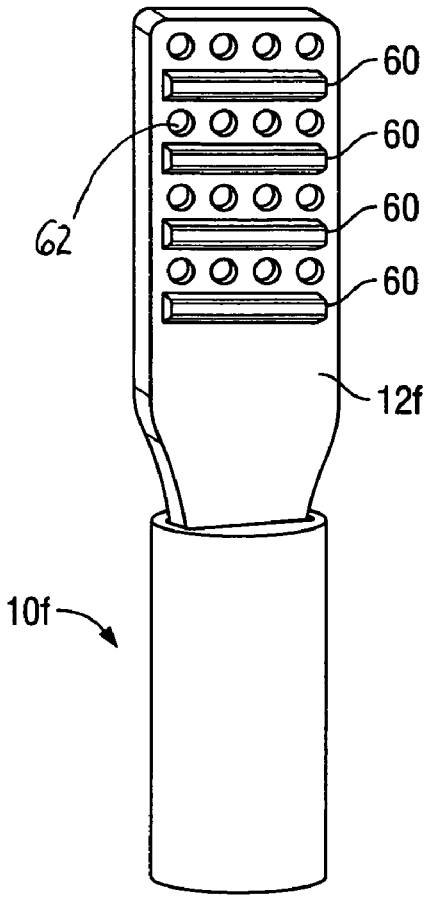
FIG. 7 is a perspective view of another embodiment of an applicator made in accordance with the teachings of the present invention.
Figure 8:
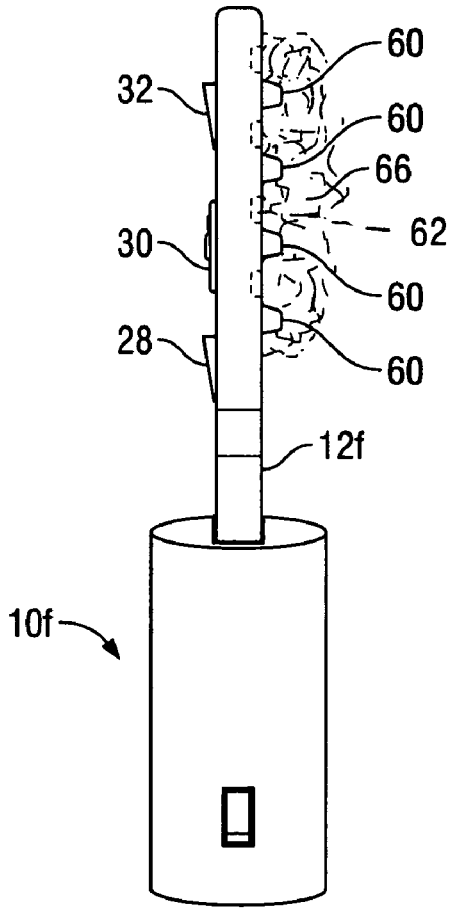
FIG. 8 is a side elevation view of the applicator of FIG. 7.
Figure 10:
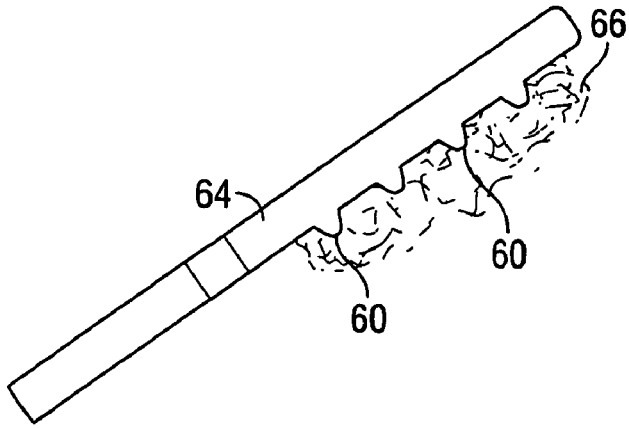
FIG. 10 is a side elevation view of a non-powered product placer for use with the applicator of the present invention.

Referring to FIGS. 7 and 8, a preferred embodiment of the applicator is shown. Applicator 10*f* is shown having elements similar to those previously described, except that applicator 10*f* has a number of ridges 60 on applicator face 12*f*. In the use of the present embodiment, product, such as shaving cream or hot oil, is pumped through applicator 10*f* and emerges though port 62, which unlike ports 14 of the previous embodiment, are within the face 12*f* of applicator 10*f*, rather than outside of the face. In this manner, with a small amount of pumping, product is pumped out of ports 62 onto ridges 60 where it can be held until it is easily placed onto the body of the user. Further, should the product, cream or oil, prove to be too hot to be placed on the body, the applicator 10*f* of the present embodiment, allows the product to cool sufficiently so that it can be safely placed onto the face or body of the user. Referring to FIG. 10, a non-powered application wand 64 is shown. Wand 64 can be used to take cream or oils from a bottle so that they can be placed onto the surface of any of the applicators (10-10*f*) shown, or can be used to remove oil or cream from any of the applicators for placement on the body. It will be understood that products can be used on the body or on the hair of the user, without departing from the novel scope of the present invention. For illustrative purposes, the applicators of FIGS. 8 and 10 are shown with product 66 shown in phantom lines to show one embodiment of product in use on an applicator of the present invention. It will be understood by persons having skill in the art that instead of ridges 60 could be in the form of the teeth of a comb, or two combs intertwined, or could be in the form of small flexible studs or other means to hold product, without departing from the novel scope of the present invention.

Figure 9:
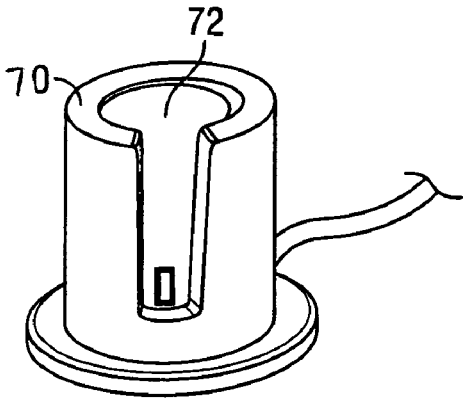
FIG. 9 is a perspective view of a recharging base of the device of the present invention.

Referring to FIG. 9, a recharge base 70, having an opening 72 into which one of the applicators of the previous figures can be installed for recharging purposes. It will be understood that the applicator can remain in the charger continuously and removed for use and the replaced to continue to receive a charge. It will be understood by persons having skill in the art that recharge circuitry that permits a trickle charge and protection from overcharging can be placed within charger 70 without departing from the novel scope of the present invention.

Figure 11:
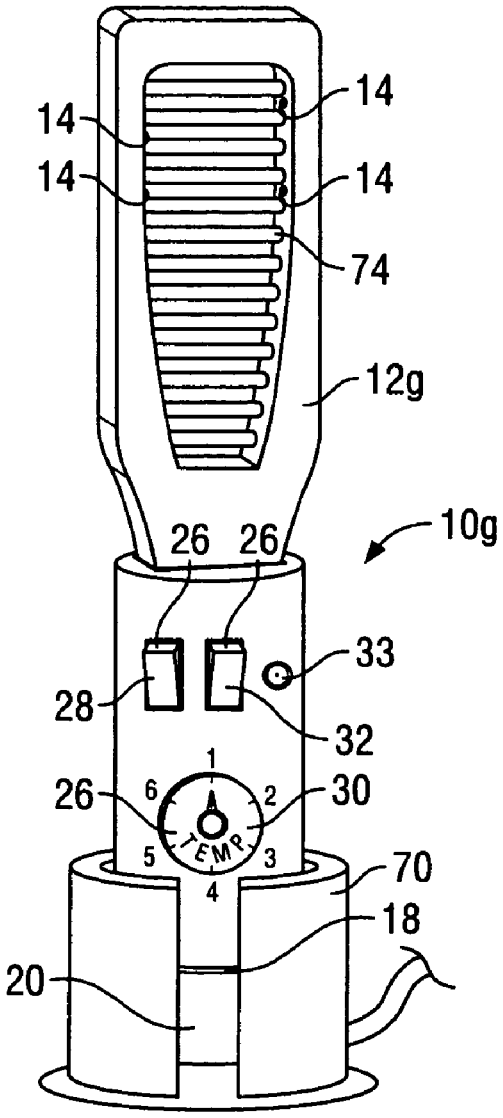
FIG. 11 is a perspective view of another embodiment of an applicator made in accordance with the teachings of the present invention.
Figure 12:
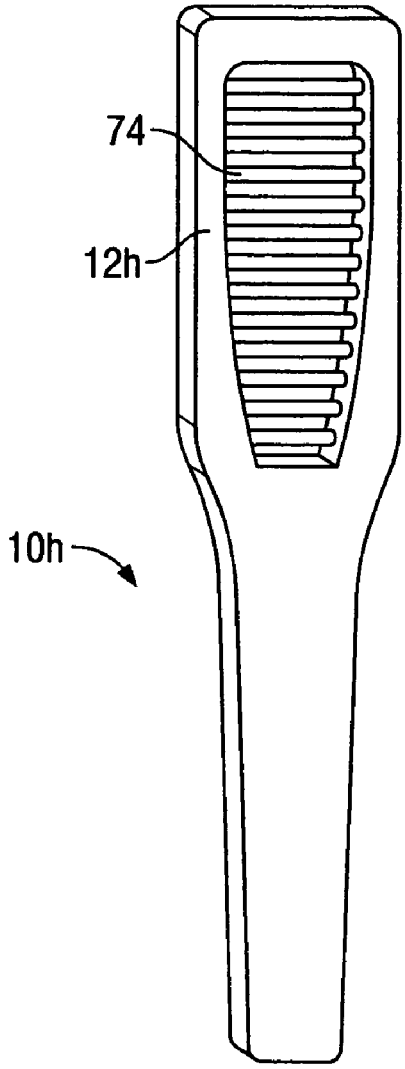
FIG. 12 is a perspective view of another embodiment of an applicator made in accordance with the teachings of the present invention.

Referring now to FIGS. 11 and 12, another preferred embodiment of the device of the present invention is shown. FIG. 11 shows a powered version of the device and FIG. 12 shows a manual applicator. It will be seen that many of the components of the applicator 10*g* of FIG. 11 are similar to those previously shown. It will be understood that the device of FIG. 11 can be powered by electrical current from an alternating current source as well as by batteries, including dry cell and rechargeable batteries. Further, it will be understood that applicator 10*g* can comprise a port 18 for receiving containers 20 or a connector 56, tube 58 and large supply of product 60, for oils, creams or other products, as illustrated in previous embodiments, without departing from the novel scope of the present invention. As illustrated in FIG. 11, applicator 10*g* is seated in a recharger 70, such as that shown in FIG. 9, however, this illustration is not meant to be a limitation on the various sources of power that can be used to run the device of the present invention.

Applicator 10*g* comprises a series of rods 74, having characteristics similar to those of the teeth of a sturdy comb, and product ports 14, similar to those shown in other embodiments. Ports 14 of the present embodiment, however, lie generally parallel to the plane of the face 12*g* of applicator 10*g*, such that the product secreted and/or pumped therethrough tends to be captured by teeth 74. In this manner, when a desired amount of product is secreted and/or pumped onto the teeth 74, the product, which rests on teeth 74 can be applied to the face or body. It will be understood that products, such as creams or oils, will tend to have some surface tension and cling abilities such that a desirable amount of product can be placed on teeth 74 and held there, by these natural forces, until applied to the body.

It will be understood that applicator 10*g* can be provide with such similar controls 26, as found in previous embodiments, as an on/off or power switch 28, a temperature control means or thermostat 30 and a vibration control 32. Added refinements, which can be incorporated into the devices of the previous embodiments, includes a vibration control 33 which can help determine the amount of vibratory action desired, as well as other refinements.

Referring now to FIG. 12, an applicator 10*h* having no electronic or control mechanisms is shown. Applicator 10*f* has the same basic configuration as applicator 10*g* of FIG. 11, without the control devices or power elements. In its use, oil or creams are applied directly from the products original container onto teeth 74. Applicator 10*h* is then used to apply the desired product onto the face or body as desired. While no heating or vibration effects are inherent in the device, the ease of placement of product for a person having difficulty in motor movements can be seen. It will be understood by persons having ordinary skill in the art that means permitting articulation of applicator 10*f*, such as those shown in FIGS. 3, 4 and 6, can be employed in a device such as the one shown in FIG. 12, without departing from the novel scope of the present invention.

Figure 13:
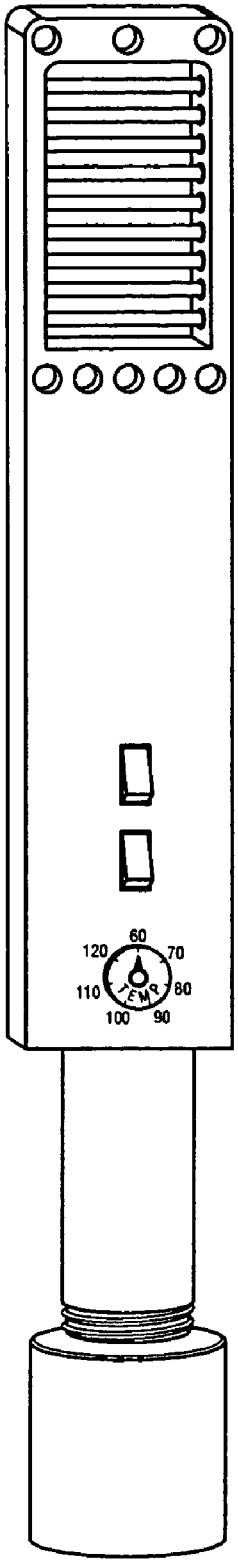
FIG. 13 is a schematic representation of a device made in accordance with the teachings of the present invention.
Figure 14:
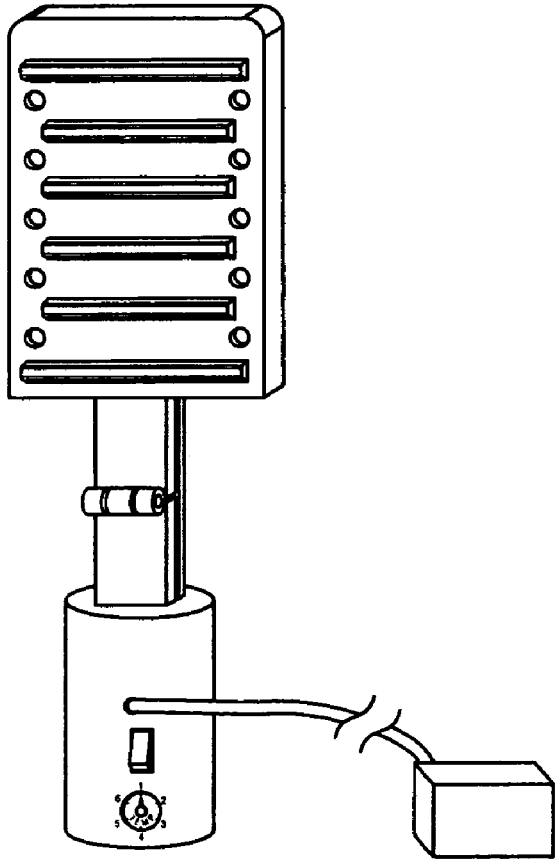
FIG. 14 is another schematic representation of a device made in accordance with the teachings of the present invention.

FIGS. 13 and 14 show further embodiments of the device of the present invention having elements similar to those shown in the embodiments of the previous figures, along with combinations of the manner in which product is delivered to the device and subsequently to the user. It will be understood by persons having ordinary skill in the art that other combination of the elements shown in the figures, and described herein can be utilized without departing from the novel scope of the present invention.

In the operation of the applicator of the present invention, a user determines the type of product he or she wishes to use and the manner of providing the product (large container or jar). The user attaches the product to the applicator and, if heated product is desired, adjust the thermostat 30 to the desired heat degree. The device is then turned on using on/off switch 28 which causes pump 44 to draw product into applicator 10, past heating coils 48 and up to dispensing ports 14. In one embodiment, the on/off switch 28 can be manipulated, in a manner well known in the art, so that only the desired or a desirable portion of product is presented to the applicator for application. The user can then adjust the angle and position of applicator face 12 and receive the product. This manner of operation is inherent in all of the powered versions of the device of the present invention.

In one preferred embodiment the device is composed of plastic with a hollow comb end to hold the shaving cream; and a vibrator device, heat element, a stem with, an off and on switch for temperature control and vibrator control. Further, the device includes a control for small pump to send the oil at variable speeds to the top of the invention from the 4½-5 inch long handle having a thickness of about ⅛ to ¼ inch. The device of the present embodiment will also have holes at the top in so as to apply warm body oils to the body.

In one embodiment of the device, the applicator has a length of about 11¼ inches and has a screw on stem, with a cap, so that product can be taken off or put on. At the bottom of the handle a 6-8 ounce jar of oil, such as baby oil, can be attached. Larger sources of product can be attached and the device can then use a power pumping station such as one that sits on the floor. In this manner more oil, cream or jelly can be used in a full body message without continuously changing bottles. In such an operation a hose line to the applicator's bottom is provided such that it can screw on, or in the alternative, snaps on in a manner known in the art. The device uses 110 volt power or dry cell batteries. The screw-on or snap on part, noted above, is for safety in water. In this manner the use of the applicators will not shock the owner when cleaning or using shaving creams.

Although an illustrative embodiment of the invention has been shown and described, it is to be understood that various modifications and substitutions may be made by those skilled in the art without departing from the novel spirit and scope of the invention.

What is claimed is:

1. A hand-held dispenser for products for self-application onto skin, comprising:

a device having a dock for infusion of products therein;

at least one port for dispensing products from the device;

a shaft, having gripping means, to assist the user in placing products onto the user's skin at a point distant from the user's hand, the shaft disposed generally between the dock and the at least one port of the device, for dispensing such that the port and dock are spaced apart by substantially the length of the shaft;

the shaft further comprising at least one joint to permit the user to bend the shaft to access skin surfaces;

a conduit, disposed between the dock and the at least one port and carried within the shaft;

motive means to draw products from the dock and through the conduit to the at least one port such that product is presented for application onto the skin.

2. The dispenser for products for self-application onto skin of claim 1, including articulating means on the shaft such that the shaft can be disposed to place product generally in any location on the user's body.

3. The dispenser for products for self-application onto skin of claim 1, including means to vibrate the dispenser to provide a massage to the skin.

4. The dispenser for products for self-application onto skin of claim 3, including means to heat the product such that the dispenser can provide a massage and provide heated product to the skin either simultaneously or alternatively.

5. The dispenser for products for self-application onto skin of claim 3, wherein the device includes means to adjust the vibration cycle of the device.

6. The dispenser for products for self-application onto skin of claim 1, including means to heat the product such that the product is warm to the skin.

7. The dispenser for products for self-application onto skin of claim 6, wherein the device includes means to adjust the temperature of the lotion.

8. The dispenser for products for self-application onto skin of claim 1, wherein the dock is removably attachable to a bottle of shaving product.

9. The dispenser for products for self-application onto skin of claim 1, wherein the dock is removably attachable to a bottle of body-type lotion.

10. The dispenser for products for self-application onto skin of claim 1, wherein the dock is removably attachable to a bottle of oil.

11. The dispenser for products for self-application onto skin of claim 1, wherein the device is powered by electricity.

12. The dispenser for products for self-application onto skin of claim 11, wherein the electric power is provided by battery.

13. The dispenser for product for self-application onto skin of claim 1, including a tube extending from the proximal end of the shaft for connection to an external supply of a product for application to skin.

14. A dispenser for products for self-application onto skin, comprising:

a shaft to assist the user in placing products onto the user's skin at a point distant from the user's hand, the shaft disposed between a dock, at the proximal end of the shaft, for infusion of products into the device and at least one port for dispensing products from the device such that the port and dock are spaced apart by substantially the length of the shaft;

the shaft further comprising at least one joint to permit the user to bend the shaft to access skin surfaces electrically powered means to vibrate the dispenser;

a conduit within the shaft, disposed between the dock and the at least one port, and carried within the shaft, through which product passes through the device;

electrically powered means, within the shaft and adjacent the conduit, to heat the product;

motive means to draw products into the dock, draw product through the conduit and bring product to the at least one port such that product is presented for application on the skin.

15. The dispenser for products for self-application onto skin of claim 14, including articulating means on the shaft such that the shaft can be disposed to place product generally in any location on the persons body.

16. The dispenser for products for self-application onto skin of claim 14, wherein the dock is removably attachable to a bottle of shaving product.

17. The dispenser for products for self-application onto skin of claim 14, wherein the dock is removably attachable to a bottle of body-type lotion.

18. The dispenser for products for self-application onto skin of claim 14, wherein the dock is removably attachable to a bottle of oil.

19. The dispenser for products for self-application onto skin of claim 14, wherein the device is battery powered.

20. The dispenser for products for self-application onto skin of claim 14, wherein the device comprises means to recharge a battery.

* * * * *